United States Patent [19]

Fukuoka

[11] 4,071,963

[45] Feb. 7, 1978

[54] VENTILATED FOOTWEAR

[76] Inventor: Sadao Fukuoka, No. 3-4, 2-Chome, Shinminamifukushima Tokushima, Tokushima, Japan

[21] Appl. No.: 750,602

[22] Filed: Dec. 15, 1976

[30] Foreign Application Priority Data

Apr. 14, 1976 Japan ..... 51-46240

[51] Int. Cl.[2] ..... A43B 7/06

[52] U.S. Cl. ..... 36/3 B

[58] Field of Search ..... 36/3 R, 3 A, 3 B

[56] References Cited

U.S. PATENT DOCUMENTS

| | | | |
|---|---|---|---|
| 3,284,930 | 11/1966 | Baldwin | 36/3 R |
| 3,475,836 | 11/1969 | Brahm | 36/3 B |
| 3,533,171 | 10/1970 | Motoki | 36/3 B |
| 3,670,429 | 6/1972 | Androsiglio | 36/3 B |

*Primary Examiner*—Patrick D. Lawson
*Attorney, Agent, or Firm*—Bernard Malina

[57] ABSTRACT

Ventilated footwear comprises an outer sole having a hollow portion forming an air pumping chamber at its heel portion, a plurality of ventilation holes provided on an inner sole within the range of the air pumping chamber, a cushioning material having cells therein to contain air being spread over an upper surface of the inner sole on the heel part thereof, projections projecting from the outer sole forming cavities between the outer sole and the inner sole, the cavities functioning as an air chamber, a plurality of ventilation holes provided on the inner sole and ducts longitudinally provided between the inner sole and the outer sole so as to communicate the air pumping chamber and the cavities. When the weight of the weather is applied to the heel part, the ventilation holes are closed and the cushioning material is depressed so as to forcibly send air from the chamber to the cavities through the ducts and when the weight of the wearer is applied to the front area of the shoe, the projections are depressed and deformed so as to force air into the inner part of the shoe through the ventilation holes.

11 Claims, 6 Drawing Figures

VENTILATED FOOTWEAR

BACKGROUND OF THE INVENTION

The present invention relates to ventilated footwear, more particularly to a shoe which allows fresh air to enter from the rear portion of the foot opening to the heel portion of the shoe and then forcing the fresh air into the front portion thereof through the inner part of the shoe and finally allowing the ventilating air to be exhausted out through the front portion of the foot opening at the top of the shoe thus completing the ventilation cycle within the shoe.

In conventional forms of footwear, there has been proposed and used projections forming an air chamber in the outer sole whereby air is caused to pass through ventilation holes provided on an inner sole from the air chamber when the tread of the outer sole unit is pressed against the ground and the projections are deformed and compressed. This ventilation in a front portion of the shoe cannot, however, perform with satisfactory efficiency due to the fact that the portion is covered and enveloped in an upper cover chamber.

Accordingly, sufficient ventilation of air can only be achieved by the air enclosed in the inner shoe due to the fact that the air in the shoe becomes high in temperature and humidity which are very harmful to feet in general.

Thus, a shoe which can achieve efficient ventilation is needed in today's active world to prevent tired, swollen and irritated feet.

SUMMARY OF THE INVENTION

An object of the present invention is to provide a new type of ventilated shoe which is so designed as to have an air pumping chamber in a heel area so that fresh air is set in motion to cause air circulation between the heel and front areas of the shoe and to freely bring about air exchange with the outside air through the inside of the heel area when the wearer is in motion.

Another object of the present invention is to provide a shoe capable of affording considerable comfort to the wearer.

A further object of the present invention is to provide a shoe which can be utilized for improving health and sanitation.

Other features and advantages of the present invention will become apparent from the following detailed description of the preferred embodiments of the invention in conjunction with the drawings.

DESCRIPTION OF THE PREFERRED EMBODIMENTS

The present invention will now be described in detail by way of preferred embodiments thereof with reference to the accompanying drawings.

Figure 1:
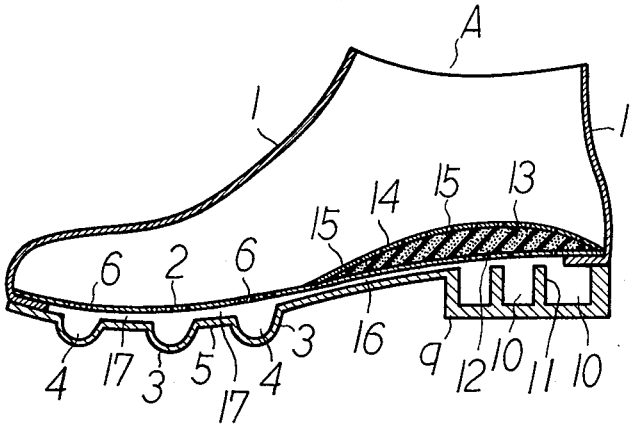
FIG. 1 is a sectional view of a shoe according to the present invention.

FIG. 1 is a sectional view of a basic embodiment of the present invention wherein numeral 9 is a heel portion constructed of preferably hardwearing material such as synthetic rubber, or synthetic resinous plastic and cavities are provided in the heel portion so as to form an air pumping chamber 10. The air pumping chamber 10 is covered at its top portion by an inner sole 2.

Numeral 11 shows webs integrally formed with the heel 9 and function as support members for the inner sole 2. The webs 11 divide the air pumping chamber 10 into three sections so that when the user, while walking or running, places the heel of the shoe down first and the air in the rearmost portion of the air pumping chamber 10 is forced into the next or middle portion of the chamber 10 and successively into the most forward portion of the chamber 10 and respectively forced toward the front of the shoe, which chamber 10, by the way, also provides a cushioning effect on the heel 9 when the foot is placed on the ground when walking. The air being forced toward the front of the shoe, is then pushed upward by the motion and pressure of the foot inside the shoe and then pushed or exhausted out of the top-front portion of the shoe and consequently, fresh air is then allowed to enter the shoe by way of the top-rear portion of the foot opening and the cycle of ventilation continues.

The inner sole member 2 has a plurality of ventilation holes 6 which are perforated therein in order to communicate with the air chamber 10 and the inside of the shoe and a cushioning material 13 having a continuous cells such as polyurethane foam or sponge rubber is provided on the upper surface of the inner sole 2 at the heel area so as to be depressed by the heel of the wearer's foot. The cushioning material 13 is entirely covered by an easily deformable sheet 14 having a plurality of ventilation holes 15. The deformable sheet 14 is fused at its rim to the inner sole 2. Thus, the area to be occupied by the cushioning material 13 must be limited in its spreading space by the rim of sheet 14 to allow the rim of sheet 14 to be fused to the inner sole 2.

Between the outer sole 5 and the inner sole 2, a communication duct 16 is provided which extends from the air chamber 10 to the front portion of the shoe thereby communicating with the air chamber 10 and cavity 4, cavity 4 being described hereinafter.

A plurality of projections 3 are integrally mounted from the outer sole 5 to form a plurality of cavities 4 between the outer sole 5 and the inner sole 2.

Figure 2:
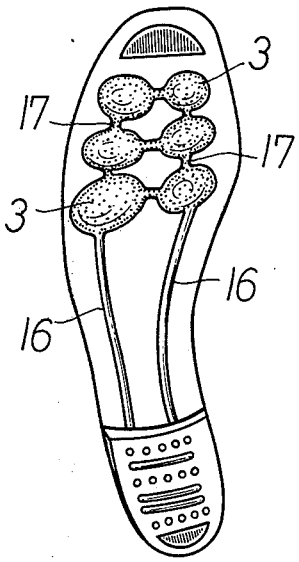
FIG. 2 is a bottom view of an outer sole of FIG. 1.

As shown in FIG. 2, the projections 3 are parallelly aligned and there are three projections in each line, each projection having a cavity 4 therein. Each cavity 4 communicates with adjacent cavities 4 via air channels 17. Fresh air is sent forth through the duct 16 from the air chamber 10 to the cavities 4. The cavities 4 projected on the sole area are deformed and compressed upon weight being applied to the shoe. Consequently, air enclosed within the cavities 4 is compressed and forcibly pushed out through ventilation holes 6 perforated in the inner sole 2 at the area facing the cavities 4. Therefore, it is necessary that the outer sole 5 be made of resiliently and deformable material such as natural rubber, or translucent rubber, synthetic rubber or polyvinyl chloride.

The inner sole 2, except for the area around the air chamber 10 and cavity 4, is fused to the upper surface of the outer sole 5 and since the inner sole 2 is secured to the upper surface of the outer sole 5, the resilience of the inner sole 2 may be thereby controlled, as desired.

Figure 6:
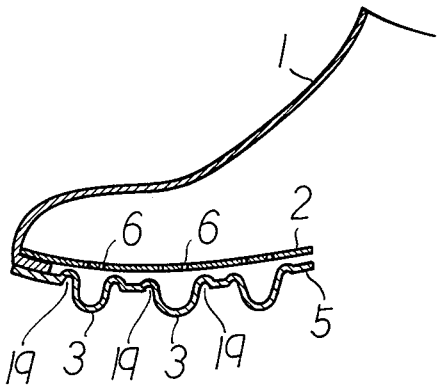
FIG. 6 is a sectional view of a still further embodiment of the present invention.

Further, as shown in FIG. 6 each projection 3 is surrounded by a groove 19 at the line of connection of the projection 3 to the outer sole 5 in order to increase the resilient deformability of the projection 3. A deformation of the projection 3 can be easily achieved thereby performing the air expulsion and intake functions with great efficiency.

The operation and function will be understood from the following description.

When the wearer depresses his shoe on the ground, the sole of the foot closes ventilation holes 6. When the weight of the wearer is applied to the heel area 9, cushioning material 13, which may be from 5 mm to 7 mm thick, is compressed. The pumping effect is achieved by depression and expansion of the cushioning material 13. Since the cushioning material 13 is made of polyurethane foam, air enclosed in the cushioning material 13 is caused to pass through ventilation holes 12 into the air chamber 10 and further, air is passed through the air duct 16 into the cavities 4. Through the two intermediate cavities 4 into which air is passed at first, the air is passed into the remaining cavities 4 and the air pressure is distributed from the cavities 4 when the weight of the wearer is applied to the front area of the shoe and the tread of the outer sole is depressed against the ground, deforming and compressing the cavities 4 thereby causing the air to be pushed out through ventilation holes 6 into the inner part of the shoe. At this time, the heel of the wearer's foot closes the ventilation holes 15 perforated in the cover sheet 14 thereby preventing the backflow of air.

When air is pushed out through the ventilation holes 6 into the inner part of the shoe and the shoe is released from load, the projections 3 return to their original condition, owing to their resilient nature, thereby causing a negative pressure to allow a flow of fresh air to move from the air chamber 10 into the cavities 4 as well as air from the inner part of the shoe to be sucked into the cavities 4 through ventilation holes 6. Thus, a considerable flow of air is produced whenever the wearer's weight is applied to the shoe. At the area of heel portion 9, the shoe is released from load and the cushioning material 13, spread over the inner part of the heel, returns to its original position and at the same time, sucks a large quantity of fresh air into the cells from the outside of the shoe by utilizing a space formed between the wearer's foot and the upper cover 1 as an air guide channel.

Other embodiments of the present invention will now be explained.

Figure 4:
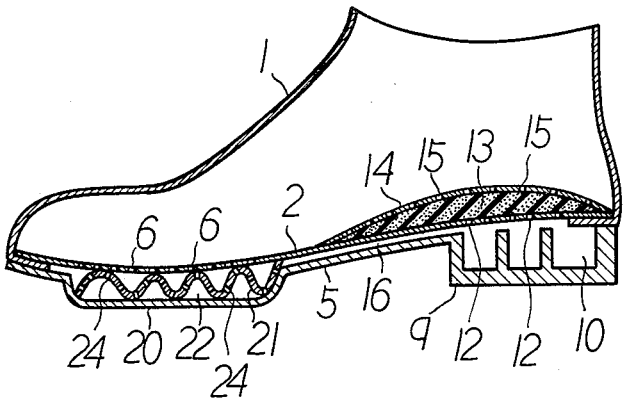
FIG. 4 is a sectional view of another embodiment of the present invention.

FIG. 4 shows another embodiment in which the outer sole 5 has a single projection 20 formed in the shape of a pan and having a large tread area. An object of this embodiment is to prevent partial deformation and to provide a shoe capable of achieving complete deformation on the outer sole 5 to thereby obtain stability for the wearer. Further, it is appparent from FIG. 4, the forward and rearward curvatures of pan-shaped projection 20 are so gently contoured, that the wearer is unaware of any difference in feeling from that of an ordinary shoe and it goes without saying that the shoe of this invention provides added health and sanitation benefits.

An air chamber 22 is formed by corrugated membrane 21 made of a deformable material which is positioned between the inner sole 2 and projection 20. The corrugated membrane 21 is preferably bonded at both its ends to the inner wall of the projection 20 by an adhesive in order to maintain the stability of the corrugated membrane 21. A plurality of ventilation holes 24 are provided in the corrugated membrane 21 to allow a free flow of air therein. The corrugated membrane 21 divides the air chamber 22 into two sections, namely, the upper and lower sections, with both sections communicating with each other via the plurality of ventilation holes 24. Further, the air chamber 22 is the communication with the air chamber 10 in heel part 9. Since this embodiment employs a comparatively large projection 20 on the tread area of the outer sole 5, the corrugated membrane 21 also acts as a reinforcing means for loads caused by the wearer and provides elasticity for the projection 20.

Accordingly, the corrugated membrane 21 is preferably made of natural or synthetic rubber or of suitably foamed polyvinyl chloride or polyethylene.

Figure 5:
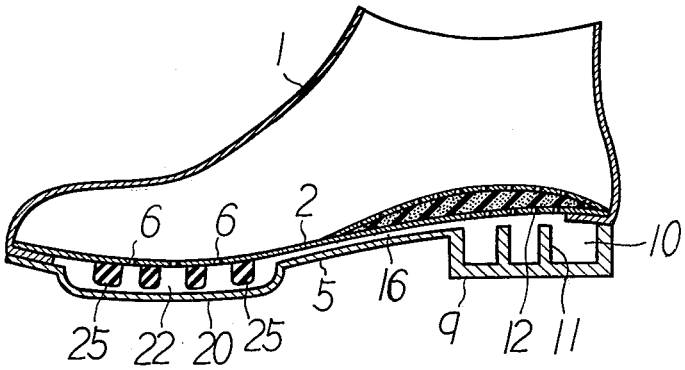
FIG. 5 is a sectional view of a further embodiment of the present invention.

FIG. 5 shows another embodiment of the present invention in which a plurality of pads 25 of resiliently deformable material such as natural rubber or polyvinyl chloride are suspended from the inner sole 2 into the air chamber 22. The plurality of pads 25 may be positioned as to form a lattice effect or may be aligned in a row. When the pads 25 are suspended from the inner sole 2, ventilation holes 6 are provided at the areas not occupied by the pads.

The function and construction of the embodiments of FIGS. 4 and 5 are similar to the first embodiment of FIG. 1.

As is apparent from the above explanation, when the weight of the wearer is applied to the shoe, the ventilation holes 15 provided on the cover sheet 14 are closed and the cushioning material 13 enclosing a large quantity of air is depressed and consequently, the air is forced out into the chamber 10. This air distribution is brought about through the duct 16 and air flows into the air chamber 22 until the air pressure becomes substantially equal in both air chambers 10 and 22.

Further, when the weight of the wearer is applied to the front area of the shoe, the projection 20 is depressed and deformed to forcibly push air into the inner part of the shoe and a compressive stress is produced in the corrugated membrane 21 and pads 25 against the applied pressure thereby reducing any shock that might be caused to the foot. Corrugated membrane 21 and pads 25 further serve to reinforce the elasticity and resiliency of the shoe.

As is apparent from the above-mentioned description, the following advantages of the present invention are thus obtained.

The heel part 9 not only has the function of pumping fresh air from the air pumping chamber 10 which also circulates fresh air from the heel part to the front part of the shoe, but also communicates with the outside air to cause continuous fresh air circulation throughout the shoe. Accordingly, the footwear of the present invention is capable of circulating fresh air from the heel part 9 to the front part thereof where air otherwise becomes hot and moist. Thus, the shoe according to the present invention prevents the wearer's feet from becoming uncomfortable and is very effective in preventing and treating dermatophytosis, commonly known as athlete's foot.

Further, according to the present invention, dampness in a shoe can be avoided and rain or dust are prevented from entering the shoe and accordingly, the shoe can be maintained in a sanitary condition at all times.

Figure 3:
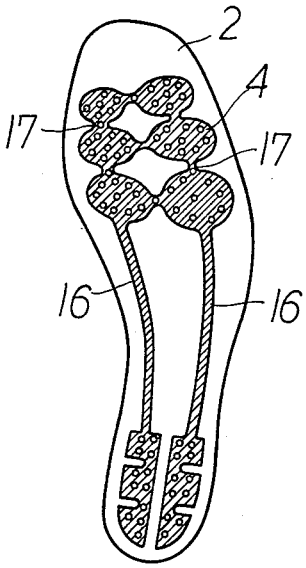
FIG. 3 is a plan view of an inner portion of a shoe for explanation of the air enclosed by the sole member.

As is shown by the oblique line in FIG. 3, a half area of the inner sole is occupied by an air chamber and a large quantity of air can be used for the purpose of ventilation.

It will be obvious that widely different embodiments of this invention may be made without departing from the spirit and scope thereof, and it is to be understood that the invention is not limited to the specific embodiments thereof except as defined in the appended claims.

What is claimed is:

1. Ventilated footwear comprising: an outer sole having a hollow portion forming an air pumping chamber at the heel portion thereof; an inner sole having a plurality of ventilation holes communicating with said air pumping chamber; a cushion made of resiliently deformable material having continuous air cells of a selected thickness mounted on the upper surface of said inner sole at least at the heel portion thereof; a sheet envelope enclosing said cushion having a plurality of ventilation perforations therein; an outer sole made of resiliently deformable material at the tread surface thereof and having at least one hollow projection extending therefrom forming an internal cavity between the internal surface of said outer sole and the bottom surface of said inner sole, operative as an air distributing chamber; at least one elongated air duct communicating at one end thereof with said air pumping chamber and at the other end thereof with said air distribution chamber, said upper sole having a plurality of ventilation holes respectively facing said projection; whereby the weight of the wearer when applied to said heel portion is operative to close said ventilation perforations and depress said cushion to thereby forcibly propel air from said air pumping chamber through said air duct and the weight of the wearer when thereafter applied to the forward area of said inner sole is operative to depress and deform said projection to thereby force air through said ventilation holes into the interior of said footwear.

2. Ventilated footwear as defined in claim 1 comprising a plurality of said elongated air ducts.

3. Ventilated footwear as defined in claim 1 wherein a plurality of said hollow projections form said air distributing cavity.

4. Ventilated footwear as defined in claim 1 including a corrugated membrane of resiliently deformable material is located within said internal cavity.

5. Ventilated footwear as defined in claim 1, including at least one pad extending from said inner sole into said cavity.

6. Ventilated footwear as defined in claim 1, wherein said projection is surrounded by a groove at the line of connection of said projection to said outer sole.

7. Ventilated footwear as defined in claim 1, wherein said cushion is made of polyurethane foam material having continuous cells.

8. Ventilated footwear as defined in claim 1, wherein said cushion is made of sponge rubber material having continuous cells.

9. Ventilated footwear as defined in claim 1, comprising a plurality of said cavities and a plurality of air channels provided between said inner sole and said outer sole and interconnecting the respective adjacent ones of said cavities.

10. Ventilated footwear as defined in claim 1, wherein said outer sole is provided with one projection of a large area, said projection forming one cavity between said inner sole and said outer sole, said cavity being provided with a corrugated membrane made of resiliently deformable material positioned therein.

11. Ventilated footwear as defined in claim 10, including a plurality of pads of resiliently deformable material extending from said inner sole into said cavity.

* * * * *